US011433561B2

(12) United States Patent
Godlieb et al.

(10) Patent No.: US 11,433,561 B2
(45) Date of Patent: Sep. 6, 2022

(54) SYSTEM AND A METHOD FOR TREATING A PART OF A BODY

(71) Applicant: KONINKLIJKE PHILIPS N.V., Eindhoven (NL)

(72) Inventors: Robert Godlieb, Eindhoven (NL); Harry Broers, Eindhoven (NL); Arnoldus Werner Johannes Oomen, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 77 days.

(21) Appl. No.: 15/031,521

(22) PCT Filed: Nov. 5, 2014

(86) PCT No.: PCT/EP2014/073767

§ 371 (c)(1),
(2) Date: Apr. 22, 2016

(87) PCT Pub. No.: WO2015/067634

PCT Pub. Date: May 14, 2015

(65) Prior Publication Data

US 2016/0257009 A1 Sep. 8, 2016

(30) Foreign Application Priority Data

Nov. 6, 2013 (EP) ..... 13191726

(51) Int. Cl.
*B26B 19/38* (2006.01)
*B26B 21/40* (2006.01)

(52) U.S. Cl.
CPC ..... *B26B 19/388* (2013.01); *B26B 21/4081* (2013.01)

(58) Field of Classification Search
CPC ..... B26B 19/388; B26B 21/4081; B26B 19/3846; B26B 19/3806; B26B 19/38; B26B 21/40
(Continued)

(56) References Cited

U.S. PATENT DOCUMENTS 1,023,542 A 4/1912 Winter
2,032,792 A 3/1936 Chulanovsky
(Continued)

FOREIGN PATENT DOCUMENTS

EP 3065919 1/2020
JP 2008257574 10/2008
(Continued)

*Primary Examiner* — Nhat Chieu Q Do

(57) ABSTRACT

The present application relates to a system and a method for treating a part of a body to be treated, particularly a system and a method for cutting hair on a part of a body to be treated. The system has a hand-held treating device having a treating unit, and an imaging module configured to generate information indicative of the position of the treating device relative to the part of the body to be treated based on an image of a part of the body and the treating device. The system also has a guide face configured to space the treating unit from the part of the body to be treated during use of the system. A controller is configured to change a distance between the treating unit and the guide face in dependence on the information generated by the imaging module.

20 Claims, 2 Drawing Sheets

(58) Field of Classification Search
USPC ..... 30/225, 355; 600/407
See application file for complete search history.

(56) References Cited

U.S. PATENT DOCUMENTS

| | | | | |
|---|---|---|---|---|
| 2,103,418 | A | 12/1937 | Hagebeuker | |
| 2,708,942 | A | 5/1955 | Fiddyment | |
| 2,765,796 | A | 10/1956 | Guenther | |
| 2,919,702 | A | 1/1960 | Olivo | |
| 2,972,351 | A | 2/1961 | Morgan | |
| 3,241,562 | A | 3/1966 | Gronier | |
| 3,413,985 | A | 12/1968 | Dlouhy | |
| 4,602,542 | A * | 7/1986 | Natrasevschi | B26B 19/00 132/214 |
| 7,982,665 | B2 | 7/2011 | Kumagai | |
| 7,992,307 | B2 * | 8/2011 | Smal | B26B 19/20 30/202 |
| 8,713,802 | B2 | 5/2014 | Fukutani | |
| 2008/0009697 | A1 * | 1/2008 | Haider | A61B 17/15 600/407 |
| 2009/0211101 | A1 * | 8/2009 | Azar | A45D 26/0009 30/41.6 |
| 2010/0298963 | A1 * | 11/2010 | Boehm | G05B 19/404 700/108 |
| 2011/0018985 | A1 * | 1/2011 | Zhu | A45D 44/00 348/61 |
| 2011/0107604 | A1 * | 5/2011 | Julemont | B26B 19/20 30/201 |
| 2012/0233866 | A1 * | 9/2012 | Kammer | B26B 19/3853 30/201 |
| 2013/0064427 | A1 * | 3/2013 | Picard | A61B 34/20 382/103 |
| 2014/0137883 | A1 * | 5/2014 | Rothschild | B26B 19/388 132/200 |
| 2015/0197016 | A1 * | 7/2015 | Krenik | B26B 19/3806 83/13 |

FOREIGN PATENT DOCUMENTS

| | | | |
|---|---|---|---|
| WO | 2013011380 | A2 | 1/2013 |
| WO | 2013096572 | A1 | 6/2013 |
| WO | 2013163999 | A1 | 11/2013 |

* cited by examiner

SYSTEM AND A METHOD FOR TREATING A PART OF A BODY

This application is the U.S. National Phase application under 35 U.S.C. § 371 of International Application No. PCT/EP2014/073767, filed on Nov. 5, 2014, which claims the benefit of International Application No. 13191726.2 filed on Nov. 6, 2013. These applications are hereby incorporated by reference herein.

FIELD OF THE INVENTION

The present invention relates to a system for treating a part of a body to be treated. In particular, the present invention relates to a system for cutting hair on a part of a body to be treated. The present invention also relates to a method for treating a part of a body to be treated.

BACKGROUND OF THE INVENTION

Devices for treating a part of a body, for example by cutting hair on a part of a body to be treated, include powered hand-held devices that are placed against a part of a user's body and moved over areas where hair is to be cut, for example a trimmer. Such devices include mechanical hair cutting devices. The user selects a cutting length by adjusting or selecting a guide, such as a comb, which extends over a cutting blade and then selects which areas of hair to cut and which areas should not be cut by positioning and moving the device appropriately.

When cutting a user's own hair, or someone else's hair, significant skill is required to create a particular hairstyle or to provide a presentable result. Although it is possible to use a trimmer to cut hair, such a device generally provides for cutting hair to a consistent length across the head. Such devices are difficult to accurately position on a user's head, for example. The accuracy of the treatment provided by the device depends on the user's skill and steady hand. Moreover, the device and the user's hand and arm may impede the user's view thereby making it difficult to position and move the device accurately. Systems are known which use a unit which is mountable to a user's head to provide positional guidance to a cutting device, however such systems are generally cumbersome and uncomfortable to a user.

SUMMARY OF THE INVENTION

It is an object of the invention to provide a system and a method for treating a part of a body to be treated which substantially alleviates or overcomes the problems mentioned above.

According to the present invention, there is provided a system for treating a part of a body to be treated comprising a hand-held treating device having a treating unit, an imaging module configured to generate information indicative of the position of the treating device relative to the part of the body to be treated based on an image of a part of the body and the treating device, and a guide face configured to space the treating device from the part of the body to be treated, wherein a controller is configured to change a distance between the treating unit and the guide face in dependence on the information generated by the imaging module.

Therefore, the system is operable to determine the position of the treating device relative to the part of the body to be treated based on an image of a part of the body and the treating device. This minimises the number of components that are required. With such an arrangement it is possible to change the distance between the treating unit and the guide face to aid performance of the treating device when the treating device is used on a part of a body to be treated, for example by cutting hair. This enables the distance between the treating unit and the part of the body to be treated to be changed using an imaging module without the need to mount any components or indicators on the user.

With this arrangement, it is possible to adjust the distance between the treating unit and the part of the body to be treated, and so vary the treatment applied to the part of the body. For example, with an arrangement for cutting hair the cutting distance is changeable to allow different lengths of hair to be cut. The controller is able to dynamically adjust the distance between the treating unit and the part of the body to be treated based on the information generated by the imaging module. Therefore, the distance is able to automatically change to provide different treating characteristics provided by the treating unit dependent on the distance.

The system for treating a part of a body to be treated may be a system for cutting hair on a part of a body to be treated, the treating device may be a cutting device, and the treating unit may be a cutting unit.

With such an arrangement, it is possible to provide a system for cutting hair which provides for different hairstyles to be produced by changing the distance between the treating unit and the guide face in dependence on the information generated by the imaging module during use of the system. Therefore, it is possible to automatically and dynamically adjust the distance as the position of the treating device relative to the part of the body to be treated, for example a user's head, changes.

The treating device may comprise a main body. The guide face may be on the main body and the treating unit may be movable relative to the main body to adjust the distance between the guide face and the treating unit.

With this arrangement it is possible to adjust the distance between the treating unit and the part of the body to be treated, when the treating device is disposed against the part of the body to be treated, without adjusting the distance between the main body of the treating device and the part of the body to be treated. Therefore, it is possible to minimise any perceived movement of the cutting device relative to the part of the body due to an adjustment between the guide face and the treating unit. Furthermore, mechanical failure due to a user attempting to resist a movement of a component of the treating device may be minimised.

The treating unit may be on the main body and the guide face may be movable relative to the main body to adjust the distance between the guide face and the treating unit.

Therefore, it is possible to simplify the arrangement of the cutting unit and the main body by minimising movement of the cutting unit towards and away from the main body. This may aid manufacture of the device.

The treating unit may further comprise an actuator, wherein the controller may be configured to adjust the actuator in dependence on the information generated by the imaging module to change the distance between the treating unit and the guide unit.

The image of a part of the body and the treating device may be an image of the part of the body to be treated and the treating device.

Therefore, the accuracy of the system may be maximised due to the image being an image of the part to be treated. Furthermore, the arrangement of the system is simplified because the imaging module is able to provide direct information about the part of the body to be treated.

The image of a part of the body and the treating device may be an image of a user's head and the treating device, wherein the imaging module may be configured to detect a gaze direction of the user's head based on the image of the user's head and the treating device.

The imaging module may be configured to detect the gaze direction of the user's head based on detection of one or more objects in the image of the user's head and the treating device and, optionally, based on detection of the user's nose and/or ears in the image of the user's head and the treating device.

With this arrangement the imaging module is capable of accurately providing information indicative of the position of the treating device relative to the user's head by detecting one or more easily identifiable objects, such as features of the head. Furthermore, by detecting the user's nose and/or ears in the image of the user's head it is possible to easily identify the gaze direction and/or determine the location of other parts of the user's head due to the user's nose and/or ears being in a fixed location relative to other parts of the user's head. It will also be recognised that the user's nose and/or ears are easily determinable by an imaging module due to the objects protruding from the remainder of the head. Although the user's nose and/or ears are easily determinable by an imaging module, it will also be recognised that the position of other features may be determined, for example a user's eyes and/or mouth due to their contrast with the remainder of the user's face.

The imaging module may comprise a range camera.

Therefore the imaging module is able to be configured to generate information indicative of the position of the treating device in a straightforward manner.

The system may further comprise an inertial measurement unit configured to generate information indicative of the position of the treating device.

Therefore, it is possible to maximise the accuracy of information indicative of the position of the treating device which is provided as part of the system. Furthermore, the inertial navigation module may allow information indicative of the position of the treating device to be provided to the controller in the event that the imaging module is unable to provide such information. This also provides a level of redundancy against failure of the imaging module.

The controller may be configured to change the distance between the treating unit and the guide face of the treating device in dependence on the information generated by the imaging module and the inertial measurement unit.

With such an arrangement it is possible to maximise the accuracy of the determined position of the treating device relative to the part of the body to be treated.

The controller may be configured to change the distance between the treating unit and the guide face of the treating device in dependence on the information generated by the imaging module and the inertial measurement unit when the treating device is out of an optical sensing zone of the imaging module.

Therefore, it is possible to help maintain and/or maximise the accuracy of the information generated by the imaging module when the treating device is out of an optical sensing zone of the imaging module.

The controller may be configured to calibrate the inertial measurement unit based on information generated by the imaging module.

With such an arrangement it is possible to maximise the accuracy of the information indicative of the position of the treating device during operation of the system. In particular, such an arrangement helps to counter against the readings of the inertial navigation system drifting over time and so accumulating a positioning error.

The imaging module may be configured to generate information indicative of the orientation of the treating device relative to the part of the body to be treated based on the image of the part of the body and the treating device.

In this case, the imaging module is also able to determine information indicative of the orientation of the treating device. This may help to maximise the accuracy of the treating. Furthermore, by the imaging module determining information indicative of the orientation of the treating device will enable an distance between the treating unit and the guide face of the treating device to be changed in dependence on the information of the orientation of the treating device generated by the imaging module.

By generating information indicative of the orientation of the treating device relative to the part of the body to be treated it is also possible to determine the angle at which the treating unit is disposed against the part of the body to be treated.

The controller may be configured to determine the distance between the treating unit and the guide face at a relative position based on a predefined distance between the treating unit and the guide face for that relative position.

The distance between the treating unit and the guide face may be a first operating characteristic that the controller is configured to change, the controller may be configured to change a second operating characteristic of the treating device in dependence on the information generated by the imaging module.

Therefore, it is possible for one or more further operating characteristics of the treating device to be changed to help the system provide an enchanced treatment for the part of the body to be treated.

According to another aspect of the invention, there is provided a treating device configured to be used in a system as described above.

According to another aspect of the present invention, there is provided a method of treating a part of a body using a treating device comprising generating information indicative of the position of the treating device relative to the part of the body to be treated based on an image of a part of the body and the treating device using an imaging module, changing the distance between a treating unit and a guide face of the treating device in dependence on the information generated by the imaging module.

With such a method it is possible to determine the position of the treating device based on an image of a part of the body and the treating device only. This minimises the number of steps that are required to change the distance between the treating unit and the guide face of the treating device based on objects, such as features, of a part of a body. With such an arrangement it is possible to change the distance between the treating unit and the guide face when the treating device is used on a part of a body to be treated, for example by cutting hair.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
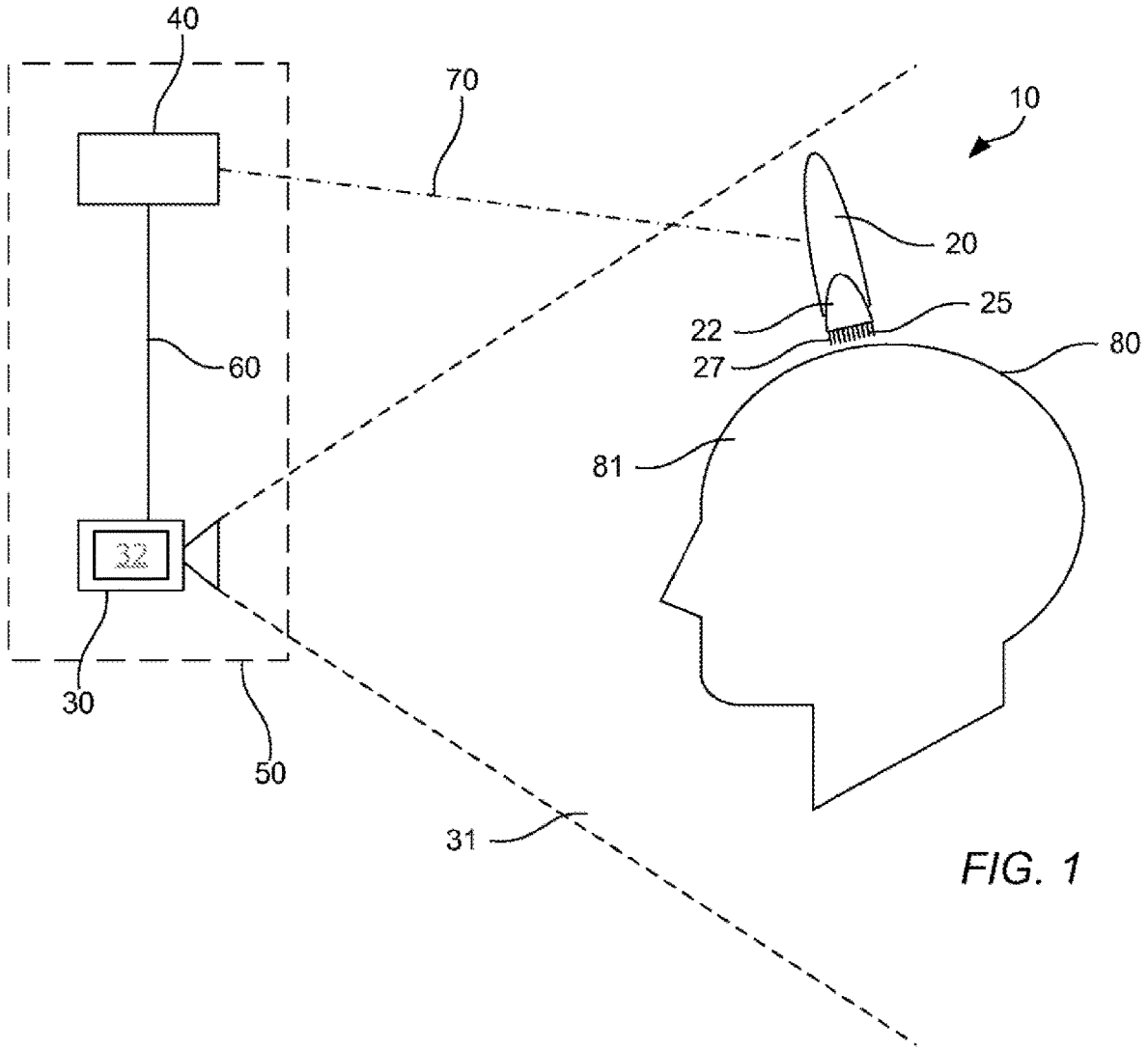
FIG. 1 shows a schematic view of a system for cutting hair.

Embodiments described herein describe a system for cutting hair. Referring to FIG. 1, a system for cutting hair 10 is shown. The system for cutting hair 10 acts as a system for treating part of a body to be treated. The system 10 comprises a cutting device 20, and a camera 30. The camera 30 acts as an imaging module. The camera 30, acting as an imaging module, is a position identifier configured to generate information indicative of the position of the treating device relative to the part of the body to be treated. That is, a position identifier is capable of generating information indicative of the position of one or more objects. The system 10 further comprises a controller 40. The controller 40 is configured to operate the cutting device 20.

In the embodiments described herein, the system 10 is described by reference to the user of the system 10 being the person being treated. That is, the user is using the system to treat themselves. However, it will be understood that in an alternative embodiment the user is a person using the system 10 to apply treatment using the system 10 to another person.

The camera 30 and controller 40 form part of a base unit 50. Alternatively, the camera 30 and controller 40 are disposed separately. The controller 40 may be in the cutting device 20. The camera 30 may be on the cutting device 20. The camera 30, controller 40 and cutting device 20 communicate with each other. In the present embodiment the camera 30 and controller 40 communicate via a wired connection 60. The controller 40 and the cutting device 20 communicate via a wireless connection 70. Alternative arrangements are envisaged. For example, the controller 40 and cutting device 20 may be connected by a wired connection, and/or the controller 40 and the camera 30 may be connected by a wireless connection. Wireless modules, for example radio or infra-red transmitters and receivers, act to wirelessly connect the different components. It will be understood that WiFi™ and Bluetooth™ technologies may be used.

The base unit 50 in the present embodiment is a dedicated part of the system 10. However, it will be understood that the base unit 50 may be a device having an imaging module and/or a controller, amongst other components. For example, the base unit 50 may be or comprise a mobile phone, tablet computer or laptop computer, another mobile device, or a non-mobile device such as a computer monitor or docking station with an in-built or attached camera. The base unit may be formed as two or more discrete secondary units.

Figure 2:
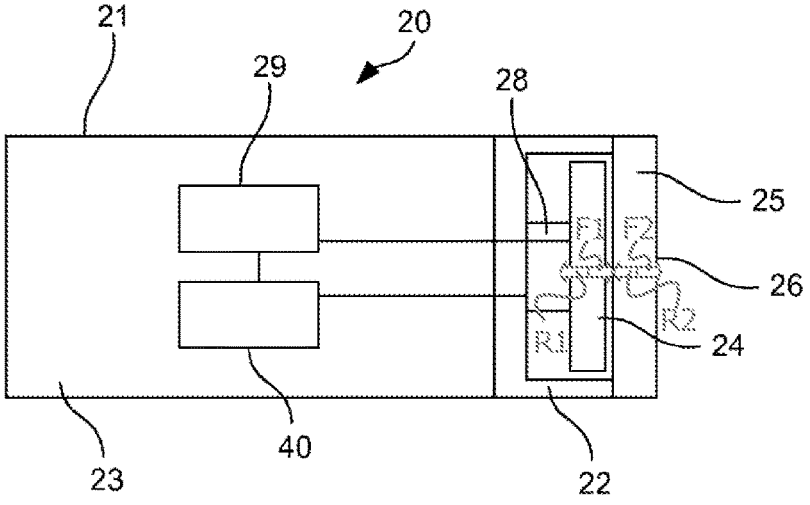
FIG. 2 shows a schematic view of a cutting device.

Referring to FIGS. 1 and 2, the cutting device 20 is a hand-held electrical hair trimming device. However, it will be apparent that the cutting device 20 may have an alternative arrangement. For example, the cutting device 20 may be a hand-held electrical shaving device. The cutting device 20 acts as a treating device. The cutting device 20 is moved over a skin 80 of a part of a user's body, for example their head 81, to trim hair on that part of the body. The cutting device 20 comprises a main body 21 and a cutting head 22 at one end of the main body 21. The main body 21 defines a handle portion 23. The body 21 and the cutting head 22 are arranged so that the handle portion 23 is able to be held by a user.

The cutting head 22 has a cutting unit 24. The cutting unit 24 is configured to trim hair. The cutting unit 24 acts as a treating unit. The cutting unit 24 has one or more stationary treating element(s) (not shown), and one or more moveable treating element(s) which move relative to the one or more stationary treating element(s). Hairs protrude past the stationary treating element, and are cut by the moveable treating element. In particular, in one embodiment the cutting unit 24 comprises a stationary blade, acting as a stationary treating element, and a moveable blade, acting as a moveable treating element. The stationary blade has a stationary edge comprising a first array of teeth. The moveable blade has a moveable edge comprising a second array of teeth. The stationary edge and moveable edge are aligned parallel to each other. The moveable blade is moveable in a reciprocal manner against the stationary blade in a hair shearing engagement. Therefore, the second array of teeth is arranged to move in a reciprocal motion relative to the first array of teeth. In the present embodiment, the stationary treating element and the moveable treating element form cooperating mechanical cutting parts (not shown).

Although one cutting unit is described above, it will be understood that the cutting head 22 may comprise two or more cutting units. Although in the present arrangement the cutting unit comprises one or more stationary treating element(s) and one or more moveable treating element(s), it will be understood that alternative cutting arrangements are envisaged. For example, the cutting unit 24 may comprise a foil (not shown) through which hairs protrude, and a moving blade (not shown) which moves over the foil.

The cutting unit 24 is driven by a driver 29. The driver 29 acts to drive the cutting unit 24 in a driving action. In the present embodiment, the driver 29 is an electric motor. The driver 29 drives the moveable element(s) relative to the stationary element(s) in a reciprocal motion. The driver 29 is controlled by the controller 40.

The cutting head 22 has a guide 25. The guide 25 has a guide face 26. The guide face 26 forms an end surface. The guide face 26 is configured to be disposed against the part of the body to be treated. The guide face 26 is spaced from the cutting unit 24. However, in one embodiment the cutting head 22 may be adjustable so that the guide face 26 and the cutting unit 24 lie planar with each other. The guide face 26 is arranged to space the cutting head 22 from the part of the body to be trimmed, for example the skin 80 of a user's head 81.

In the present embodiment, the guide 25 is a comb. The guide 25 has a plurality of parallel, but spaced, comb teeth 27. The spaced comb teeth 27 allow the passage of hair therebetween to be exposed to the cutting unit 24 to be cut by the cutting unit 24. A distal surface of each tooth from the main body 21 forms the guide face 26. The guide 25 is mounted to the main body 21. The guide 25 is removably mounted to the main body 21. This enables the cutting unit 24 to be cleaned, and the guide 25 to be interchangeable with another guide and/or replaced.

The guide 25 has a leading edge. The leading edge is aligned with the moveable edge of the moveable treating element, but is spaced therefrom. The leading edge forms an edge of the guide face 26. The leading edge is defined by ends of the comb teeth 27. The leading edge defines an intersection between the guide face 26 of the guide 25 and a front face of the guide 25.

The distance between the guide face 26 and the cutting unit 24 is adjustable. That is, the guide face 26 and the cutting unit 24 are moveable towards and away from each other. The distance between the guide face 26 and the cutting unit 24 acts as a first operating characteristic. In the present embodiment the guide 25 is fixedly mounted to the main body 21. That is, the guide 25 is prevented from moving towards or away from the main body 21. However, the guide 25 may pivot about the main body 21. The cutting unit 24 is movably mounted to the main body 21. That is, the cutting unit 24 is movable towards the guide face 26 in a forward direction F1 and movable away from the guide face 26 in a rearward direction R1. The cutting unit 24 may also be pivotable relative to the main body 21. An actuator 28 acts on the cutting unit 24. The actuator 28 extends in the cutting head 22. The actuator 28 is operable to move the cutting unit 24 relative to the guide face 26. The actuator 28 is a linear actuator, and may be a mechanical actuator or an electromagnetic actuator, for example.

The cutting unit 24 of this embodiment is mounted on the actuator 28 which is configured to move the cutting unit 24 in a linear direction F1 towards the skin contacting surface 26 or is a linear direction R1 away from the skin contacting guide face 26, and therefore the skin 80 of the user during use. The actuator 28 moves the cutting unit 24 in response to commands from the controller 40.

Depending on the type of actuator used, the cutting unit 24 may be mounted on a linear sliding guide or rail such that the cutting unit 24 moves, under influence of the actuator 28, and remains parallel to the guide face 26. The movement may be in direction which is perpendicular to the guide face 26 or it may be at an angle.

With the above arrangement the cutting unit 24 moves relative to the guide face 26. Therefore, the guide face 26 is maintained in a stationary position with respect to the main body 21. This means that the distance between the guide face 26 and the handle 23 does not change during use of the cutting device 20. Therefore, there is no perceived movement of the cutting device 20 in a user's hand.

The distance between the cutting unit 24 and the guide face 26 is variable such that the cutting device 20 is at or between a minimum condition, in which the distance between the cutting unit 24 and the guide face 26 is at a minimum value, and a maximum condition, in which the distance between the cutting unit 24 and the guide face 26 is at a maximum value.

The cutting device 20 of the present embodiment is configured to have a maximum condition of about 100 mm. However, it will be understood that alternative ranges are possible. For example, a shaver for trimming facial hair may be configured to set a maximum condition of 10 mm. Such a reduced range may increase the accuracy of the cutting device 20.

Although in the above described embodiment the cutting unit 24 is movable relative to the guide face 26, in an alternative embodiment the guide 25, and therefore the guide face 26, is movable relative to the cutting unit 24. The cutting unit 24 may be fixedly mounted to the main body 21, and the guide 25 may be movable relative to the main body 21 in a forward direction F2 and in a reward direction R2. In such an embodiment, the actuator acts on the guide 25. The guide face 26 is movable towards the cutting unit 24 in the rearward direction R2 and movable away from the cutting unit 24 in the forward direction F2. The guide 25 may be slideable on one or more rails to slide relative to the cutting unit 24. With such an embodiment, the arrangement of the cutting unit 24 is simplified.

In the above described arrangement the distance between the guide face 26 and the cutting unit 24 is adjustable by means of operation of the actuator. However, in one embodiment the distance between the guide face 26 and the cutting unit 24 is also manually adjustable by a user.

The camera 30, acting as an imaging module, is a depth or range camera. That is, the camera 30 uses range imaging to determine the position of elements within the field-of-view, or optical sensing zone 31, of the camera 30.

The camera 30 produces a two-dimensional image 32 with a value for the distance of elements within the optical sensing zone 31 from a specific position, such as the camera sensor itself. In the present embodiment the camera 30 is configured to employ a structured light technique to determine the position, including the distance, of elements within the optical sensing zone 31 of the camera 30. Such a technique illuminates the field of view with a specially designed light pattern. An advantage of this embodiment is that the depth may be determined at any given time using only the single image 32 of the reflected light. Alternatively, the camera 30 is configured to employ a time-of-flight technique to determine the position, including the distance, of elements within the field of view of the camera 30. An advantage of this embodiment is that the number of moving parts is minimised. Other techniques include echographic technologies, stereo triangulation, sheet of light triangulation, interferometry, and coded aperture.

The camera 30 is a digital camera capable of generating image data representing a scene received by the camera's sensor. The image data can be used to capture a succession of frames as video data. The optical sensing zone 31 is the field-of-view within which optical waves reflecting from or emitted by objects are detected by the camera's sensors. The camera 30 detects light in the visible part of the spectrum, but can also be an infra-red camera.

The camera 30, acting as the imaging module, is configured to generate information indicative of the position of elements within the optical sensing zone 31. The camera 30 generates the information based on the image data generated by the camera's sensor.

In the present embodiment, the camera 30, acting as the imaging module, generates a visual image with depth, for example an RGB-D map. The camera 30 generates a visual image with depth map of the elements within the optical sensing zone 31 of the camera 30. Alternative means of generating information indicative of the position of elements within the optical sensing zone 31 are anticipated. For example, the camera 30 may generate a depth image (D-map) of the elements within the optical sensing zone 31.

The camera 30 is configured to generate a visual image with depth map with 30 frames per minute. Furthermore, the camera 30 has a resolution of 640×480. The depth range is between 0.4 m and 1.5 m. The angle of the field-of-view is between 40 degrees and 50 degrees. This provides a suitable area for a user to be positioned within the optical sensing zone 31. The depth resolution is configured to be about 1.5 mm within the optical sensing zone 31.

Whilst the above parameters have been found to be sufficient for accurate determination of position for cutting hair, it will be understood that alternative parameters may be used. For example, a filter (not shown) may be used to enhance accuracy of the available resolution.

Figure 3:
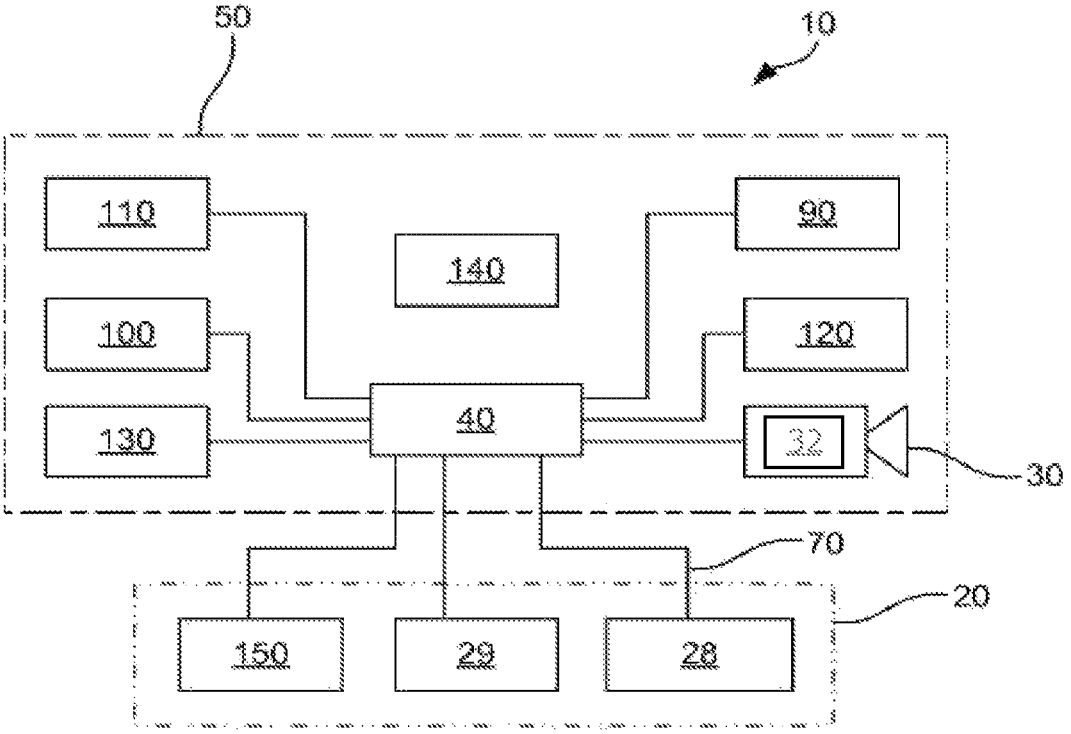
FIG. 3 shows a schematic diagram of the system of FIG. 1.

FIG. 3 shows a schematic diagram of selected components of the system 10. The system 10 has the cutting device 20, the camera 30, and the controller 40. The system 10 also has a user input 90, memory 100, RAM 110, one or more feedback modules, for example including a speaker 120 and/or a display 130, and a power supply 140. Furthermore, the system 10 has an inertial measurement unit (IMU) 150.

The memory 100 may be a non-volatile memory such as read only memory (ROM), a hard disk drive (HDD) or a solid state drive (SSD). The memory 100 stores, amongst other things, an operating system. The memory 100 may be disposed remotely. The controller 40 may be able to refer to one or more objects, such as one or more profiles, stored by the memory 100 and upload the one or more stored objects to the RAM 110.

The RAM 110 is used by the controller 40 for the temporary storage of data. The operating system may contain code which, when executed by the controller 40 in conjunction with the RAM 110, controls operation of each of the hardware components of the system 10. The controller 40 may be able to cause one or more objects, such as one or more profiles, to be stored remotely or locally by the memory 100 and/or to the RAM 110.

The power supply 140 may be a battery. Separate power supply units 140*a*, 140*b* of the power supply may separately supply the base unit 50 and the cutting device 20. Alternatively, one power supply unit may supply power to both the base unit 50 and the cutting device 20. In the present embodiments, the or each power supply unit is an in-built rechargeable battery, however it will be understood that alternative power supply means are possible, for example a power cord that connects the device to an external electricity source.

The controller 40 may take any suitable form. For instance, the controller 40 may be a microcontroller, plural controllers, a processor, or plural processors. The controller 40 may be formed of one or multiple modules.

The system 10 also comprises some form of user interface. Optionally, the system 10 includes additional controls and/or displays for adjusting some operating characteristic of the device, such as the power or cutting height, and/or informing the user about a current state of the device.

The speaker 120 is disposed in the base unit 50. Alternatively, the speaker may be on the cutting device 20 or disposed separately. In such an arrangement, the speaker will be disposed close to a user's head to enable audible signals generated by the speaker 120 to be easily heard by a user. The speaker 120 is operable in response to signals from the controller 40 to produce audible signals to the user. It will be understood that in some embodiments the speaker 120 may be omitted.

The display 130 is disposed in the base unit 50. Alternatively, the display 130 may be disposed on the cutting device 20 or disposed separately. The display 130 is operable in response to signals from the controller 40 to produce visual indicators or signals to the user. It will be understood that in some embodiments the display 130 may be omitted.

The feedback module, or one of the feedback modules, may also include a vibration motor, for example to provide tactile feedback to a user.

The user input 90 in the present embodiment includes one or more hardware keys (not shown), such as a button or a switch. The user input 90 is disposed on the base unit 50, although it will be understood that the user input 90 may be on the cutting device 20, or a combination thereof. The user input 90 is operable, for example, to enable a user to select an operational mode, to activate the system 10, and/or disable the system 10. The user input 90 may also include mechanical means to allow manual adjustment of one or more elements of the system 10.

The inertial measurement unit 150 is in the cutting device 20. In the present arrangement, the IMU 150 is received in the main body 21 of the cutting device 20. IMUs are known and so a detailed description will be omitted herein. The IMU 150 is configured to provide the readings of six axes of relative motion (translation and rotation). The IMU 150 is configured to generate information indicative of the position of the cutting device 20. The information generated by the IMU 150 is provided to the controller 40.

The system 10 of FIG. 1 is operated by disposing the base unit 50 in a suitable location for cutting hair. That is, the base unit 50 is positioned so that the user is able to position the part of the body to be treated, for example the head, within the optical sensing zone 31. For example, the camera 30 is disposed around a height at which a user's head will be positioned during operation of the system 10. In an embodiment in which the camera 30 is separate from the base unit 50, or the base unit is omitted, the camera 30 is positioned as necessary. The hand-held cutting device 20 is held by the user.

The system 10 is actuated by a user operating the user input 90. The controller 40 controls the driver 29 to operate the cutting unit 24 in a cutting mode. It will be understood that the cutting unit 24 may have more than one treating modes. The controller 40 controls the actuator 28 to determine the position of the cutting unit 24 relative to the guide face 26.

When the system is actuated, the cutting device 20 is at or between a minimum condition, in which the distance between the cutting unit 24 and the guide face 26 is at a minimum value, and a maximum condition, in which the distance between the cutting unit 24 and the guide face 26 is at a maximum value. The controller 40 initially moves into a maximum condition so that the hair is not able to be accidentally cut to a shorter length than desired.

The user uses the system 10 by holding the hand-held cutting device 20 and moving the cutting device 20 over areas of part of the body from which hair is to be cut. The guide face 26 of the cutting head 22 is placed flat against the skin and hairs being received through the guide 25 and interacting with the cutting unit 24 are cut. For example, for trimming hair in the scalp area of a user's head 81, the user positions the guide face 26 against the scalp and moves the cutting device 20 over the skin 81 from which hair to be trimmed protrudes. The user can move the cutting device 20 around the surface of the scalp. The hair being cut as the cutting device 20 is moved over the skin 81 will depend on the size and shape of the guide face 26 of the guide 25 which is disposed proximate to the skin and also on the size, shape and arrangement of the cutting unit 24 of the cutting head 22.

With a conventional trimmer, the extent of the cutting action of the trimmer is difficult to predict and control and the user relies on their skill and steady hand to move the device in the appropriate manner. Furthermore, the length of the hair to be cut is dependent on a user controlling a distance between the guide face of the device and the user's skin such that the trimmed length of the hair being cut, or by moving the guide into a desired position to set the cut length. This can be difficult when holding the device as any undue movement of the skin or hand may cause a mistake. Furthermore, the device and/or the hand or arm of the user may obstruct the view of the user when the device is in use and this may result in the device being moved in an undesired manner and cause inaccuracies or mistakes. Therefore, it is difficult to use such a device to achieve accurate cutting of hairs.

The invention as defined in the claims provides a system for treating a part of a body to be treated, including cutting hair, which allows for variations in the treatment, such as cutting hair, applied to a part of the body to be treated dependent on the position of the treating device relative to the part of the body to be treated. The system is operable to provide information indicative of the position of the treating device relative to the part of the body to be treated, and to change the distance between the cutting unit 24 and the guide face 26 of the treating device in dependence on the provided information.

The method of how the system 10 is used comprises an initial step of the user, who may be cutting hair on a part of their own body, or of another user's body, positions the cutting device 20 with respect to the part of the body on which hair is to be cut, for example the user's head. The camera 30, acting as the imaging module, is operable to generate information indicative of the position of the cutting device 20, as well as the part of the body to be treated. In the present embodiment, the camera 30 generates image data representing a scene received by the camera's sensor within the optical sensing zone 31. With such an embodiment, the camera 30 produces a depth map, for example a visual image with depth map of the objects within the optical sensing zone 31.

The camera 30 is operable to generate information indicative of the part of the body to be treated based on the image produced of objects within the optical sensing zone 31. For example, the camera 30 is operable to generate information indicative of the user's head based on the image produced within the optical sensing zone 31 including the user's head. The camera 30 is configured to generate information indicative of the position and/or orientation of the user's head. To effectively determine the location of the user's head from the available map of the objects within the optical sensing zone 31, features of the user's head are identified.

In such an embodiment, the camera 30 is configured to detect a gaze direction of the user's head. That is the direction in which the head is directed relative to the camera 30. Detection of the gaze direction of the user's head based on detection of one or more objects in the image of the user's head and the treating device and, optionally, based on detection of the user's nose and/or ears in the image of the user's head and the treating device. It has been found that a user's nose and/or ears are easily locatable in an image produced of objects in the optical sensing zone 31. As a user's nose and ears protrude from the remainder of a user's head, the camera 30, it has been found that one or more of these objects are easily locatable in an image including a user's head.

Features of the user's head, for example the user's nose and/or ears, are identified by the camera 30. It has been found that the nose and ears may be detected rapidly and continuously in the depth map produced by the camera 30, acting as the imaging module, using a known detection method, for example 3D pattern matching. Although in the present arrangement the camera 30 is configured to identify the user's nose and/or ears, it will be understood that the camera 30 may be configured to detect one or more alternative features of the part of the body in the optical sensing zone 31. For example, the camera 30 may be configured to detect the shape of the user's head, eyes, lips, blemishes, scars, birthmarks and/or other facial features. Such features may be identified by the camera 30 and stored by the controller 40 in the memory 100 for reference during use of the system 10, or during future use of the system 10.

An advantage of the camera 30 being configured to detect a gaze direction of the user's head based on detection of the user's ears and nose in the image of the user's head is that generally two or more of these three features will be identifiable in the image of the part of the body irrespective of the gaze direction of the user's head. Therefore, from the overall position and orientation of these three features, it is possible to generate information indicative of the position of the position of the head across a range of different head positions relative to the camera 30. Therefore, movements of the head may be accommodated during use of the system.

The camera 30 is operable to generate information indicative of the cutting device 20, acting as a treating device. The shape of the cutting device 20 is known and may be stored, for example by the memory 100, to be referred to during operation of the camera 30. The position of the cutting device 20 is determined in a similar manner to that of the part of the body to be treated. To effectively determine the location of the cutting device 20 from the available map of the objects within the optical sensing zone 31, features of the cutting device 20 are identified. The cutting device 20 may be provided with markers (not shown) which are easily recognisable by the camera 30.

The camera 30 is configured to accommodate part of the cutting device 20 being obscured in the image produced of objects within the optical sensing zone 31. That is, the camera 30 is configured to identify two or more features of the cutting device 20 such that the camera is able to determine the location of the cutting device 20 from the available map of the objects within the optical sensing zone 31 even when one or more of the features of the cutting device 20 are occluded by another object, for example a user's hand, in the image produced of objects within the optical sensing zone 31.

Although in the above embodiment the image of the part of the body of which an image is produced corresponds to the image of the part of the body to be treated, it will be understood that the invention is not limited thereto. For example, the camera 30 may generate image data including data representative of a lower part of a user's head, and the system 10 may extrapolate this date to generate information indicative of the upper part of a user's head.

Although the camera 30 is capable of determining the position of the cutting device 20 from the available map of the objects within the optical sensing zone 31 when at least one of the features of the cutting device 20 is identifiable in the image produced of objects within the optical sensing zone 31, it has been found that the cutting device 20 may be completely occluded in the image, for example when the cutting device 20 is disposed to treat the back of the user's head and the user's gaze direction is towards the camera 30.

When the camera 30 is unable to provide information indicative of the position of the cutting device 20, or indicates that the treating device 20 is not found within the image data representing a scene received by the camera's sensor within the optical sensing zone 31, the controller 40 is configured to refer to information indicative of the position of the cutting device 20 provided by the IMU 150. The IMU 150 is disposed in the cutting device 20 and may be operable throughout use of the system 10, or only when operated by the controller 40, for example when the camera 30 is unable to detect the cutting device 20, that is out of the optical sensing zone 31 of the camera 30.

The IMU 150 is configured to generate information indicative of the position of the cutting device 20 based on the IMU's own position in the cutting device 20. The IMU 150 provides readings of 6 axes of relative motion translation and rotation.

The controller 40 may be configured to calibrate the IMU 150 based on information generated by the camera 30 when the cutting device 20 is within the optical sensing zone 31. This helps to remove positioning errors due to the readings of the IMU 150 over time.

Although in the present embodiment the controller 40 is configured to refer to information generated by the IMU 150 when the treating device is out of an optical sensing zone of the imaging module, it will be understood that the controller 40 may be configured to refer to information generated by the imaging module and the inertial navigation system module throughout use of the system 10. In an alternative embodiment, the IMU 150 may be omitted. In such an embodiment information indicative of the position of the cutting device relative to the part of the body to be treated may be determined by extrapolation of the image data representing a scene received by the camera's sensor within the optical sensing zone 31. Alternatively, the controller 40 may be configured to provide feedback to a user, for example by audio signals, to guide the user to change their gaze direction relative to the camera 30 so that the cutting device 20 is within the optical sensing zone 31, and the camera is able to generate image data representing a scene received by the camera's sensor within the optical sensing zone 31.

With the position of the part of the body to be treated, in this case the user's head, and the cutting device 20 known the camera 30, acting as the imaging module, it is possible to determine the position of the cutting device 20 relative to the part of the body to be treated based on the image of a part of the body and the cutting device 20. The relative positions may be calculated based on vector subtraction. Therefore, the relative positions may be easily determined.

Although in the above described embodiment the relative positions of the cutting device 20 and the part of the user's head to be treated are determined by the camera 30, it will be understood that the information generated by the camera 30 indicative of the position of the cutting device 20 and the part of the user's head to be treated may be provided to the controller 40 or another component of the system 10, which is configured to determine the relative positions of the cutting device 20 and the part of the user's head based on the information provided.

When the user places the cutting device 20 against the user's head and moves the device over the user's head, the system 10 is able to determine the relative positions of the cutting device 20 relative to the part of the body to be treated based on the image data generated by camera 30 of the part of the body and the cutting device. The controller 40 receives data from the camera 30 and the controller 40 is configured to adjust an operating characteristic in response to the date received. In this embodiment, the operating characteristic is the distance between the cutting unit 24 and the guide face 26.

Although in the present embodiment the operating characteristic that is changed by the controller 40 is the distance between the cutting unit 24 and the guide face 26, it will be understood that other operating characteristics of the cutting device 20 may also be changed. It will be appreciated that a second operating characteristic of the device which is changed depends on the purpose and function of the device and the invention as defined in the claims and is not limited to any particular type of device for treating hair and/or skin. Therefore, the controller may be configured to alter any characteristic of the device in dependence on the information generated by the imaging module.

The controller 40 is configured to refer to a reference profile of the part of the body to be treated. The reference profile may be stored in a look-up table. The reference profile may be stored by the memory 100. In such an arrangement, the controller 40 is configured to refer to the memory 100 to access the reference profile.

The reference profile provides information of a desired setting for the operating characteristic to be altered by the controller, in this case the distance between the cutting unit 24 and the guide face 26, for each position of the cutting device 20 relative to the part of the body to be treated. Such information is communicated and stored with reference to a coordinate system. One such configuration uses a polar coordinate system in which each position on the part of the body to be treated is determined by a distance from a fixed point and an angle from a fixed direction. Another configuration uses a Cartesian coordinate system. For each point a condition, such as a value, of the operating characteristic is given. Alternatively, the reference profile may define a map of the part of the user's body to be treated which is divided into predefined areas and a condition of the operating characteristic is given for each area.

Although in one arrangement every possible position may be assigned a condition of the operating characteristic, in an alternative embodiment a limited number of positions are assigned a condition, and the controller 40 is configured to extrapolate and interpolate the condition for other positions based on the one or more given limited number of positions. In such an arrangement, a change in the condition for a determined position may be a step change. Alternatively, the controller 40 may configure the change to be continuous and gradual. An advantage of such an approach is that an even haircut may be achieved.

The controller 40 is configured to adjust the setting for the distance between the cutting unit 24 and the guide face 26 by comparing the provided information indicative of the position of the treating device relative to the part of the body to be treated with reference information provided by the reference profile and adjusting the distance between the cutting unit 24 and the guide face 26 to correspond to the reference data.

The controller 40 operates the actuator 28 to adjust the distance between the cutting unit 24 and the guide face 26. As the cutting unit 24 is moved over the part of the body to be treated, the controller is configured to change the distance between the cutting unit 24 and the guide face 26 in dependence on the determined position of the cutting device 20 relative to the part of the body to be treated. It will be understood that the cutting unit 24 and guide face 26 will both have an operating zone over which treatment will be provided. That is, the cutting unit 24 will have a treating zone which, when positioned over a section of the part of the body to be treated, will affect treatment, for example hair cutting, on said section. Therefore, the treating zone may overlay two or more positions having different desired conditions of the first operating characteristic. To help prevent undesired treatment, such as hair from being cut too short, in such a situation the controller 40 is configured to select the condition closest to a default condition. For example, in the present embodiment the controller 40 is configured to select the greatest distance between the cutting unit 24 and the guide face 26 provided by the two or more desired conditions. The other condition or conditions will subsequently be met by repeated, but slightly different, passes of the cutting device 20 over the part of the body to be treated.

Once a full transversal of the part of the body to be treated has been completed, the user is able to move the cutting device 20 away from the part of the body to be treated. It will be understood that the cutting device 20 may be moved away from the part of the body to be treated during treatment, and the system 10 will be able to continue to operate when the cutting device 20 is moved back towards the part of the body to be treated.

Although in the above described embodiment one reference profile is used, it will be understood that the controller 40 may be configured to select from two or more reference profiles in response to a user input, or in response to information generated by the camera based on an image of a part of the body. For example, the controller 40 may be configured to select a reference profile based on a size of the head of the user as determined by the camera 30.

In an alternative embodiment not shown in the Figures, the controller does not adjust the performance of an actuator in dependence on the information generated by the imaging module, but rather informs the user of the cutting device via one or more feedback modules, for example the speaker 120 and/or display 130. For example, while the cutting device is in use the controller will alter an operating characteristic of the feedback unit to inform the user in dependence on the information generated by the imaging module so that they can take the appropriate action. The feedback module may provide an acoustic signal, in the form of an audible sound such as a beeping sound. Alternatively, the feedback module may provide tactile feedback in the form of vibrations that are felt by the user via the handle of the device. Alternatively, the feedback module may provide an optical signal, such as flashing light or other optical indicator. It will be appreciated that the feedback module may also provide more than one of the above mentioned signals in dependence on the information generated by the imaging module.

Although in the above described embodiments the camera is a depth camera, it will be understood that alternative imaging modules may be used. For example, alternative vision systems acting as an imaging module may be used. Such an alternative vision system may include a non-range camera, for example using an object reconstruction technique, or stereo vision, temporal analysis of video to reconstruct range data and detect the head position and cutting device position, analysis of thermal camera images, analysis of data from ultrasonic sensors, and/or analysis of data from capacitive sensors.

Although in the above described embodiments, the system and method are described as a system for cutting hair on a part of a body and a method of cutting hair on a part of a body, it will be understood that the invention is not limited thereto. For example, the system and method may be used as an alternative treatment of a part of the body to be treated. The operating characteristic that is altered in dependence on the information generated by the imaging module will depend on the purpose and function of the device.

It will be appreciated that the system and/or method as defined in the claims may be used for any method of treating hair or skin. For example, the device may be an epilator, shaver, trimmer, exfoliator, laser hair cutting device, moisturiser or any other powered device which interacts with the hair and/or skin of a user. Alternatively, the device may apply a substance such as colouring agent, shampoo, medical substance or any other substance to the hair or skin of the user. Possible alternative uses include systems incorporating one or more non-invasive or invasive treatments such as a tooth brush, a shaver, alternative types of hair removal other than cutting, skin cleaning, skin tanning, and/or skin rejuvenation. In such embodiments, the treating of a part of body may include application of light, application of a lotion or other fluids, and/or puncturing.

The device may have two or more cutting units. In such an arrangement the controller may be configured to adjust an operating characteristic of the different cutting units in different ways. For example, in an arrangement with two cutting units the cutting height of one of the cutting units may be altered independently of the other of the cutting units. Therefore, it will be appreciated there are many ways in which the controller is able to adjust an operating characteristic of a device having multiple cutting units.

It will be appreciated that the term "comprising" does not exclude other units or steps and that the indefinite article "a" or "an" does not exclude a plurality. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. A system for cutting hair on a part of a body to be treated, the system comprising:

a hand-held treating device having a treating unit;

an imaging module configured to generate information indicative of a position of the treating device relative to the part of the body to be treated based on identifying anatomical features in an image of the body and the treating device, wherein the generated information comprises a two-dimensional visual image with a depth map for determining the position of elements within a field of view;

a guide face configured to space the treating unit from the part of the body to be treated;

a memory configured to store a reference profile of the part of the body to be treated, wherein the reference profile includes settings for an operating characteristic of the treating device relative to the part of the body to be treated; and a controller configured to change a distance between the treating unit and the guide face based on the reference profile and the information generated by the imaging module indicative of the position of the treating device relative to the part of the body to be treated.

2. The system according to claim 1, wherein:

the treating device is a cutting device; and the treating unit is a cutting unit.

3. The system according to claim 1, wherein:

the treating device includes a main body;

the guide face is on the main body; and the treating unit is movable relative to the main body to adjust the distance between the guide face and the treating unit.

4. The system according to claim 1, wherein:

the treating device includes a main body;

the treating unit is on the main body; and the guide face is movable relative to the main body to adjust the distance between the guide face and the treating unit.

5. The system according to claim 1, wherein:

the treating unit further comprises an actuator; and the controller is configured to adjust the actuator to change the distance between the treating unit and the guide face in dependence on the information generated by the imaging module indicative of the position of the treating device relative to the part of the body to be treated.

6. The system according to claim 1, wherein the image of the body and the treating device is an image of the part of the body to be treated and the treating device.

7. The system according to claim 1, wherein:

the image of the body and the treating device is an image of a user's head and the treating device; and the imaging module is configured to detect a gaze direction of the user's head based on the image of the user's head and the treating device.

8. The system according to claim 7, wherein the imaging module is configured to detect the gaze direction of the user's head based on at least one of:

a detection of one or more objects in the image of the user's head and the treating device; and a detection of the user's nose and/or ears in the image of the user's head and the treating device.

9. The system according to claim 1, further comprising an inertial measurement unit configured to generate information indicative of a position of the treating device.

10. The system according to claim 9, wherein the controller is configured to change the distance between the treating unit and the guide face in dependence on the information generated by the imaging module indicative of the position of the treating device relative to the part of the body to be treated and in dependence on the information generated by the inertial measurement unit indicative of the position of the treating device.

11. The system according to claim 9, wherein the controller is configured to calibrate the inertial measurement unit based on information generated by the imaging module indicative of the position of the treating device relative to the part of the body to be treated.

12. The system according to claim 1, wherein the imaging module is configured to generate information indicative of an orientation of the treating device relative to the part of the body to be treated based on the image of the body and the treating device.

13. The system according to claim 1, wherein the controller is configured to determine the distance between the treating unit and the guide face at a relative position based on a predefined distance between the treating unit and the guide face for that relative position.

14. The system according to claim 1, wherein:

the distance between the treating unit and the guide face is a first operating characteristic that the controller is configured to change; and the controller is further configured to change a second operating characteristic of the treating device in dependence on the information generated by the imaging module indicative of the position of the treating device relative to the part of the body to be treated.

15. A method of cutting hair on a part of a body to be treated using a treating device having a treating unit and further using a guide face spacing the treating unit from the part of the body to be treated, the method comprising:

generating information, via an imaging module, indicative of a position of the treating device relative to the part of the body to be treated based on identifying anatomical features in an image of the body and the treating device, wherein the generated information comprises a two-dimensional visual image with a depth map for determining the position of elements within a field of view;

retrieving, from a memory, a reference profile of the part of the body to be treated, wherein the reference profile includes settings for an operating characteristic of the treating device relative to the part of the body to be treated; and changing, via a controller, a distance between the treating unit and the guide face based on the reference profile and the information generated by the imaging module indicative of the position of the treating device relative to the part of the body to be treated.

16. The method of claim 15, the treating device is a cutting device; and the treating unit is a cutting unit.

17. The method of claim 15, wherein the treating device includes a main body; and further comprising one of:

moving the treating unit relative to the main body to adjust the distance between the guide face and the treating unit; or moving the guide face relative to the main body to adjust the distance between the guide face and the treating unit.

18. The method of claim 15, further comprising:

generating information indicative of an orientation of the treating device relative to the part of the body to be treated based on the image of the body and the treating device.

19. The method of claim 15, further comprising:

generating information indicative of a position of the treating device utilizing an inertial measurement unit, and changing the distance between the treating unit and the guide face based on the information generated by the imaging module indicative of the position of the treating device relative to the part of the body to be treated and in based on the information generated by the inertial measurement unit indicative of the position of the treating device.

20. The method of claim 15, wherein the distance between the treating unit and the guide face is a first operating characteristic of the treating device; and changing a second operating characteristic of the treating device based on the information generated by the imaging module indicative of the position of the treating device relative to the part of the body to be treated.

* * * * *